US009080317B2

(12) United States Patent
Matsuyama

(10) Patent No.: US 9,080,317 B2
(45) Date of Patent: Jul. 14, 2015

(54) EXCAVATION CONTROL SYSTEM AND CONSTRUCTION MACHINE

(75) Inventor: Toru Matsuyama, Kanagawa (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 13/983,099

(22) PCT Filed: Feb. 7, 2012

(86) PCT No.: PCT/JP2012/052686
§ 371 (c)(1),
(2), (4) Date: Aug. 1, 2013

(87) PCT Pub. No.: WO2012/127913
PCT Pub. Date: Sep. 27, 2012

(65) Prior Publication Data

US 2013/0302124 A1 Nov. 14, 2013

(30) Foreign Application Priority Data

Mar. 24, 2011 (JP) ..... 2011-066825

(51) Int. Cl.

| | |
|---|---|
| ***E02F 3/43*** | (2006.01) |
| ***E02F 3/30*** | (2006.01) |
| ***E02F 9/22*** | (2006.01) |
| ***E02F 9/26*** | (2006.01) |

(52) U.S. Cl.
CPC . *E02F 3/435* (2013.01); *E02F 3/30* (2013.01); *E02F 3/437* (2013.01); *E02F 9/2203* (2013.01); *E02F 9/262* (2013.01); *E02F 9/265* (2013.01)

(58) Field of Classification Search
CPC ..... E02F 3/435; E02F 3/437; E02F 3/30
USPC ..... 701/50
See application file for complete search history.

(56) References Cited

U.S. PATENT DOCUMENTS

2005/0027420 A1 2/2005 Fujishima et al.

FOREIGN PATENT DOCUMENTS

| | | |
|---|---|---|
| EP | 1 541 772 A1 | 6/2005 |
| JP | 8-134949 A | 5/1996 |

(Continued)

OTHER PUBLICATIONS

International Search Report for PCT/JP2012/0052686 issued on May 15, 2012.

(Continued)

*Primary Examiner* — Redhwan k Mawari
*Assistant Examiner* — Rodney P King
(74) *Attorney, Agent, or Firm* — Global IP Counselors, LLP

(57) ABSTRACT

An excavation control system includes a working unit, hydraulic cylinders, a prospective speed obtaining part, a speed limit selecting part and a hydraulic cylinder controlling art. The prospective speed part is configured to obtain a first prospective speed depending on a first distance between the bucket and a first designed surface, and a second prospective speed depending on a second distance between the bucket and a second designed surface. The speed limit selecting part is configured to select one of the first and second prospective speeds as a speed limit based on a relative relation between the first designed surface and the bucket and a relative relation between the second designed surface and the bucket. The hydraulic cylinder controlling part is configured to limit a relative speed of the bucket relative to one of the first and second designed surfaces to the speed limit.

18 Claims, 10 Drawing Sheets

(56) References Cited

FOREIGN PATENT DOCUMENTS

| | | | | |
|---|---|---|---|---|
| JP | 2006-265954 | A | | 10/2006 |
| JP | 2006265954 | A | * | 10/2006 |
| JP | 2008-106440 | A | | 5/2008 |
| JP | 2009-179968 | A | | 8/2009 |
| WO | 95/30059 | A1 | | 11/1995 |

OTHER PUBLICATIONS

The Office Action for the corresponding German patent application No. 11 2012 001 013.2, issued on Mar. 12, 2015.

The Office Action for the corresponding Korean patent application No. 10-2013-7020979, issued on Jan. 26, 2015.

* cited by examiner

EXCAVATION CONTROL SYSTEM AND CONSTRUCTION MACHINE

CROSS-REFERENCE TO RELATED APPLICATIONS

This application claims priority to Japanese Patent Application No. 2011-066825, filed on Mar. 24, 2011, the disclosure of which is hereby incorporated herein by reference in its entirety.

BACKGROUND

1. Field of Invention

The present invention relates to an excavation control system configured to impose a limitation on the speed of a working unit and a construction machine including the excavation control system.

2. Background Information

For a construction machine equipped with a working unit, a method has been conventionally known that a predetermined region is excavated by moving a bucket along a designed surface indicating a target shape for an excavation object (see PCT International Publication No. WO95/30059).

Specifically, a control device in PCT International Publication No. WO95/30059 is configured to correct an operation signal to be inputted by an operator so that the relative speed of the bucket relative to the designed surface is reduced as an interval is reduced between the bucket and the designed surface. Thus, an excavation control of automatically moving the bucket along the designed surface is executed by imposing a limitation on the speed of the bucket.

SUMMARY

However, according to the excavation control described in PCT International Publication No. WO95/30059, in excavating first and second designed surfaces located adjacently to each other, the second designed surface cannot be recognized while an excavation work is executed along the first designed surface. Therefore, chances are that the second designed surface is damaged.

The present invention has been produced in view of the aforementioned situation, and is intended to provide an excavation control system capable of appropriately executing an excavation control relative to a plurality of designed surfaces and a construction machine.

An excavation control system according to a first aspect includes a working unit, a plurality of hydraulic cylinders, a prospective speed obtaining part, a speed limit selecting part and a hydraulic cylinder controlling part. The working unit is formed by a plurality of driven members including a bucket, and is rotatably supported by a vehicle main body. The plurality hydraulic cylinders are configured to drive the plurality of driven members. The prospective speed obtaining part is configured to obtain a first prospective speed and a second prospective speed, the first prospective speed depending on a first distance between the bucket and a first designed surface indicating a target shape for an excavation object, and the second prospective speed depends on a second distance between the bucket and a second designed surface indicating a target shape for the excavation target, and the second designed surface is set differently from the first designed surface. The speed limit selecting part is configured to select either of the first prospective speed or the second prospective speed as a speed limit based on a relative relation between the first designed surface and the bucket and a relative relation between the second designed surface and the bucket. The hydraulic cylinder controlling part is configured to limit a relative speed of the bucket to the speed limit, and the relative speed is relative to either one designed surface of the first and second designed surfaces which is a target of the speed limit.

An excavation control system according to a second aspect relates to the excavation control system according to the first aspect, and further includes a relative speed obtaining part. The relative speed obtaining part is configured to obtain a first relative speed of the bucket relative to the first designed surface and a second relative speed of the bucket relative to the second designed surface. The speed limit selecting part is configured to select the speed limit based on a relative relation between the first relative speed and the first prospective speed and a relative relation between the second relative speed and the second prospective speed.

An excavation control system according to a third aspect relates to the excavation control system according to the first aspect, and wherein the speed limit selecting part is configured to select the speed limit based on the first distance and the second distance.

It is possible to provide an excavation control system appropriately capable of executing an excavation control with respect to a plurality of designed surfaces and a construction machine.

DESCRIPTION OF EMBODIMENTS

Explanation will be hereinafter made for an exemplary embodiment of the present invention with reference to the drawings. In the following explanation, a hydraulic excavator will be explained as an example of "construction machine".

Overall Structure of Hydraulic Excavator 100

Figure 1:
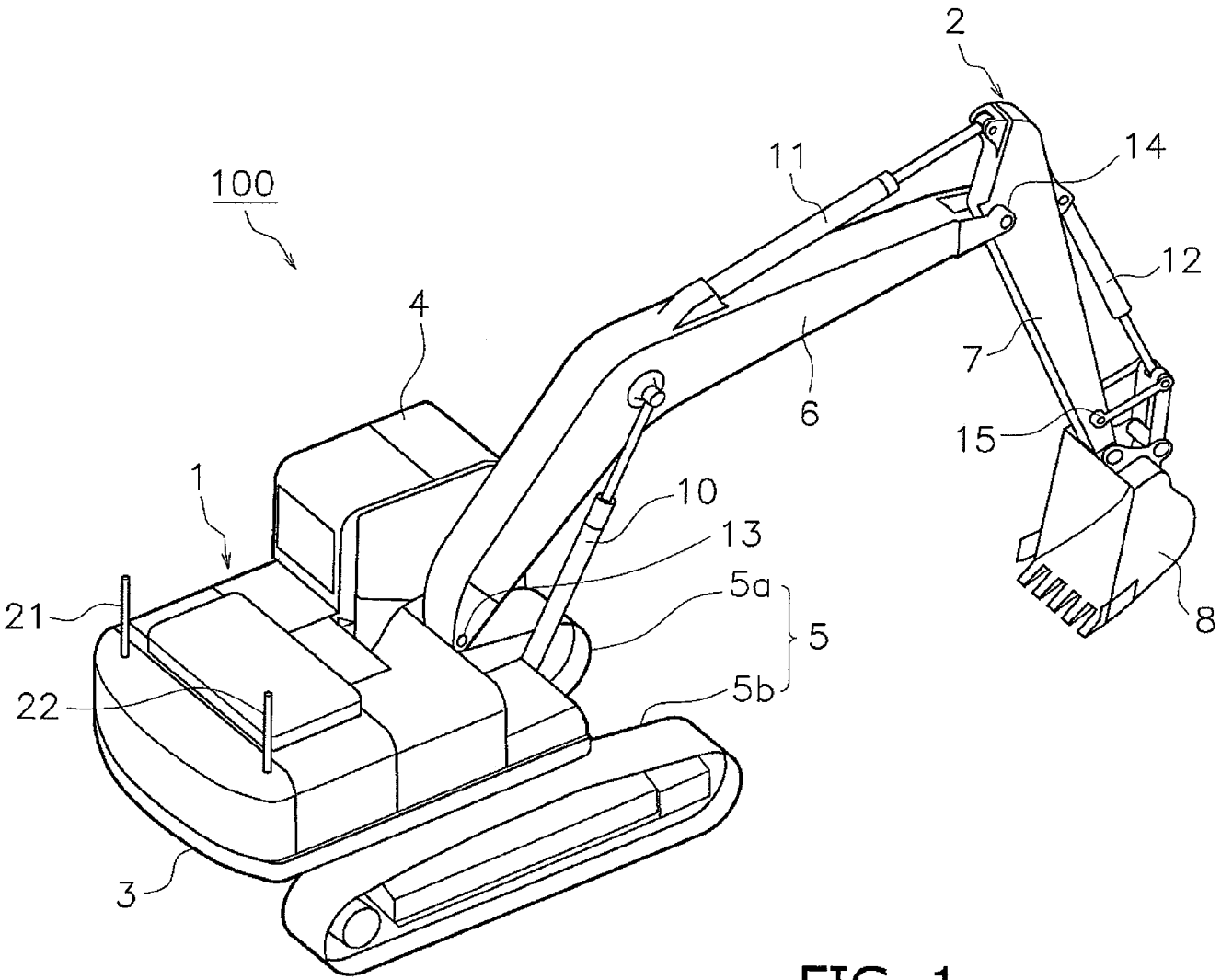
FIG. 1 is a perspective view of a hydraulic excavator 100.

FIG. 1 is a perspective view of a hydraulic excavator 100 according to an exemplary embodiment. The hydraulic excavator 100 includes a vehicle main body 1 and a working unit 2. Further, the hydraulic excavator 100 is embedded with an excavation control system 200. Explanation will be made below for a configuration and an action of the excavation control system 200.

The vehicle main body 1 includes an upper revolving unit 3, a cab 4 and a drive unit 5. The upper revolving unit 3 accommodates an engine, a hydraulic pump and so forth (not illustrated in the figures). A first GNSS antenna 21 and a second GNSS antenna 22 are disposed on the rear end part of the upper revolving unit 3. The first GNSS antenna 21 and the second GNSS antenna 22 are antennas for RTK-GNSS (Real Time Kinematic—GNSS, note GNSS refers to Global Navigation Satellite Systems). The cab 4 is mounted on the front part of the upper revolving unit 3. An operating device 25 to be described is disposed within the cab 4 (see FIG. 3). The drive unit 5 includes crawler belts 5*a* and 5*b*, and circulation of the crawler belts 5*a* and 5*b* enables the hydraulic excavator 100 to travel.

The working unit 2 is attached to the front part of the vehicle main body 1, and includes a boom 6, an arm 7, a bucket 8, a boom cylinder 10, an arm cylinder 11 and a bucket cylinder 12. The base end of the boom 6 is pivotally attached to the front part of the vehicle main body 1 through a boom pin 13. The base end of the arm 7 is pivotally attached to the tip end of the boom 6 through an arm pin 14. The bucket 8 is pivotally attached to the tip end of the arm 7 through a bucket pin 15.

The boom cylinder 10, the arm cylinder 11 and the bucket cylinder 12 are respectively hydraulic cylinders to be driven by means of an operating oil. The boom cylinder 10 is configured to drive the boom 6. The arm cylinder 11 is configured to drive the arm 7. The bucket cylinder 12 is configured to drive the bucket 8.

Figure 2A:
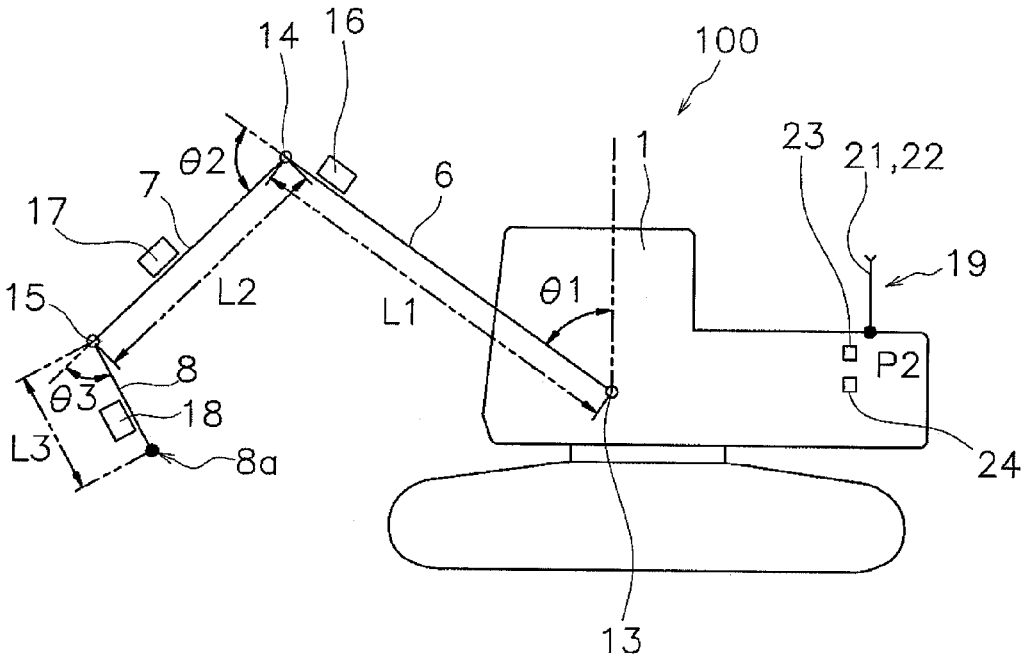
FIG. 2A is a side view of the hydraulic excavator 100.
Figure 2B:
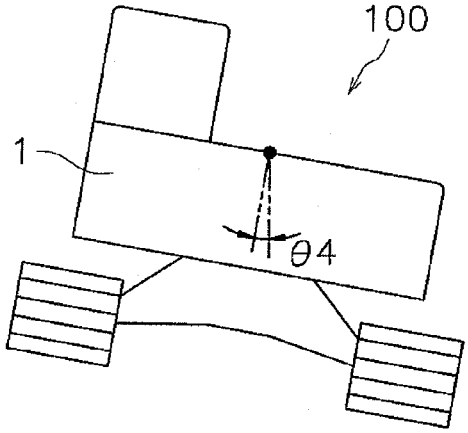
FIG. 2B is a rear view of the hydraulic excavator 100.

Now, FIG. 2A is a side view of the hydraulic excavator 100, whereas FIG. 2B is a rear view of the hydraulic excavator 100. As illustrated in FIG. 2A, the length of the boom 6, i.e., the length from the boom pin 13 to the arm pin 14 is L1. The length of the arm 7, i.e., the length from the arm pin 14 to the bucket pin 15 is L2. The length of the bucket 8, i.e., the length from the bucket pin 15 to the tip ends of teeth of the bucket 8 (hereinafter referred to as "a cutting edge 8*a*") is L3.

Further, as illustrated in FIG. 2A, the boom 6, the arm 7 and the bucket 8 are provided with first to third stroke sensors 16 to 18 on a one-to-one basis. The first stroke sensor 16 is configured to detect the stroke length of the boom cylinder 10 (hereinafter referred to as "a boom cylinder length N1"). Based on the boom cylinder length N1 detected by the first stroke sensor 16, a display controller 28 to be described (see FIG. 3) is configured to calculate a slant angle θ01 of the boom 6 with respect to the vertical direction in the Cartesian coordinate system of the vehicle main body. The second stroke sensor 17 is configured to detect the stroke length of the arm cylinder 11 (hereinafter referred to as "an arm cylinder length N2"). Based on the arm cylinder length N2 detected by the second stroke sensor 17, the display controller 28 is configured to calculate a slant angle θ2 of the arm 7 with respect to the boom 6. The third stroke sensor 18 is configured to detect the stroke length of the bucket cylinder 12 (hereinafter referred to as "a bucket cylinder length N3"). Based on the bucket cylinder length N3 detected by the third stroke sensor 18, the display controller 28 is configured to calculate a slant angle θ3 of the cutting edge 8*a* included in the bucket 8 with respect to the arm 7.

The vehicle main body 1 is equipped with a position detecting unit 19. The position detecting unit 19 is configured to detect the present position of the hydraulic excavator 100. The position detecting unit 19 includes the aforementioned first and second GNSS antennas 21 and 22, a three-dimensional position sensor 23 and a slant angle sensor 24. The first and second GNSS antennas 21 and 22 are disposed while being separated at a predetermined distance in the vehicle width direction. Signals in accordance with GNSS radio waves received by the first and second GNSS antennas 21 and 22 are configured to be inputted into the three-dimensional position sensor 23. The three-dimensional position sensor 23 is configured to detect the installation positions of the first and second GNSS antennas 21 and 22. As illustrated in FIG. 2B, the slant angle sensor 24 is configured to detect a slant angle θ4 of the vehicle main body 1 in the vehicle width direction with respect to a gravity direction (a vertical line).

Configuration of Excavation Control System 200

Figure 3:
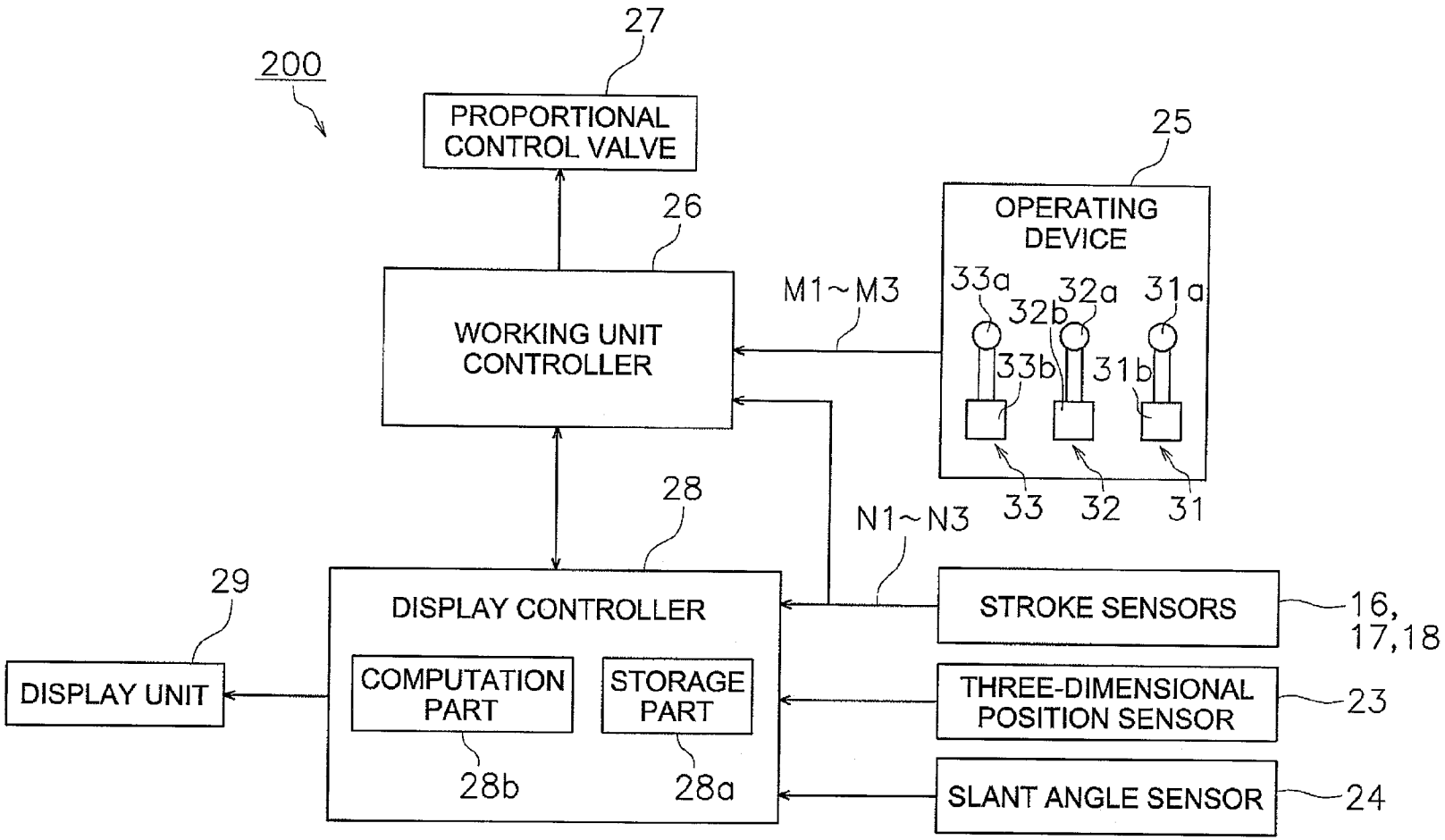
FIG. 3 is a block diagram representing a functional configuration of an excavation control system 200.

FIG. 3 is a block diagram representing a functional configuration of the excavation control system 200. The excavation control system 200 includes the operating device 25, a working unit controller 26, a proportional control valve 27, the display controller 28 and a display unit 29.

The operating device 25 is configured to receive an operator operation to drive the working unit 2 and is configured to output an operation signal in accordance with the operation of the operator. Specifically, the operating device 25 includes a boom operating tool 31, an arm operating tool 32 and a bucket operating tool 33. The boom operating tool 31 includes a boom operating lever 31*a* and a boom operation detecting part 31*b*. The boom operating lever 31*a* receives an operation of the boom 6 by the operator. The boom operation detecting part 31*a* is configured to output a boom operation signal M1 in response to an operation of the boom operating lever 31*a*. An arm operating lever 32*a* receives an operation of the arm 7 by the operator. An arm operation detecting part 32*b* is configured to output an arm operation signal M2 in response to an operation of the arm operating lever 32*a*. The bucket operating tool 33 includes a bucket operating lever 33*a* and a bucket operation detecting part 33*b*. The bucket operating lever 33*a* receives an operation of the bucket 8 by the operator. The bucket operation detecting part 33*b* is configured to output a bucket operation signal M3 in response to an operation of the bucket operating lever 33*a*.

The working unit controller 26 is configured to obtain the boom operation signal M1, the arm operation signal M2 and the bucket operation signal M3 from the operating device 25. The working unit controller 26 is configured to obtain the boom cylinder length N1, the arm cylinder length N2 and the bucket cylinder length N3 from the first to third stroke sensors 16 to 18, respectively. The working unit controller 26 is configured to output control signals based on the aforementioned various pieces of information to the proportional control valve 27. Accordingly, the working unit controller 26 is configured to execute an excavation control of automatically moving the bucket 8 along a plurality of designed surfaces 45 (see FIG. 4). At this time, as described below, the working unit controller 26 is configured to correct the boom operation signal M1 and then output the corrected boom operation signal M1 to the proportional control valve 27. On the other hand, the working unit controller 26 is configured to output the arm operation signal M2 and the bucket operation signal M3 to the proportional control valve 27 without correcting the signals M2 and M3. A function and an action of the working unit controller 26 will be described below.

The proportional control valve 27 is disposed among the boom cylinder 10, the arm cylinder 11, the bucket cylinder 12 and a hydraulic pump (not illustrated in the figures). The proportional control valve 27 is configured to supply the operating oil at a flow rate set in accordance with the control signal from the working unit controller 26 to each of the boom cylinder 10, the arm cylinder 11 and the bucket cylinder 12.

The display controller 28 includes a storage part 28*a* (e.g., a RAM, a ROM, etc.) and a computation part 28*b* (e.g., a CPU, etc.). The storage part 28*a* stores a set of working unit data that contains the aforementioned lengths, i.e., the length L1 of the boom 6, the length L2 of the arm 7 and the length L3 of the bucket 8. The set of working unit data contains the minimum value and the maximum value for each of the slant angle θ1 of the boom 6, the slant angle θ2 of the arm 7 and the slant angle θ3 of the bucket 8. The display controller 28 can be communicated with the working unit controller 26 by means of wireless or wired communication means. The storage part 28*a* of the display controller 28 has preliminarily stored a set of designed landform data indicating the shape and the position of a three-dimensional designed landform within a work area. The display controller 28 is configured to cause the display unit 29 to display the designed landform based on the designed landform, detection results from the aforementioned various sensors, and so forth.

Figure 4:
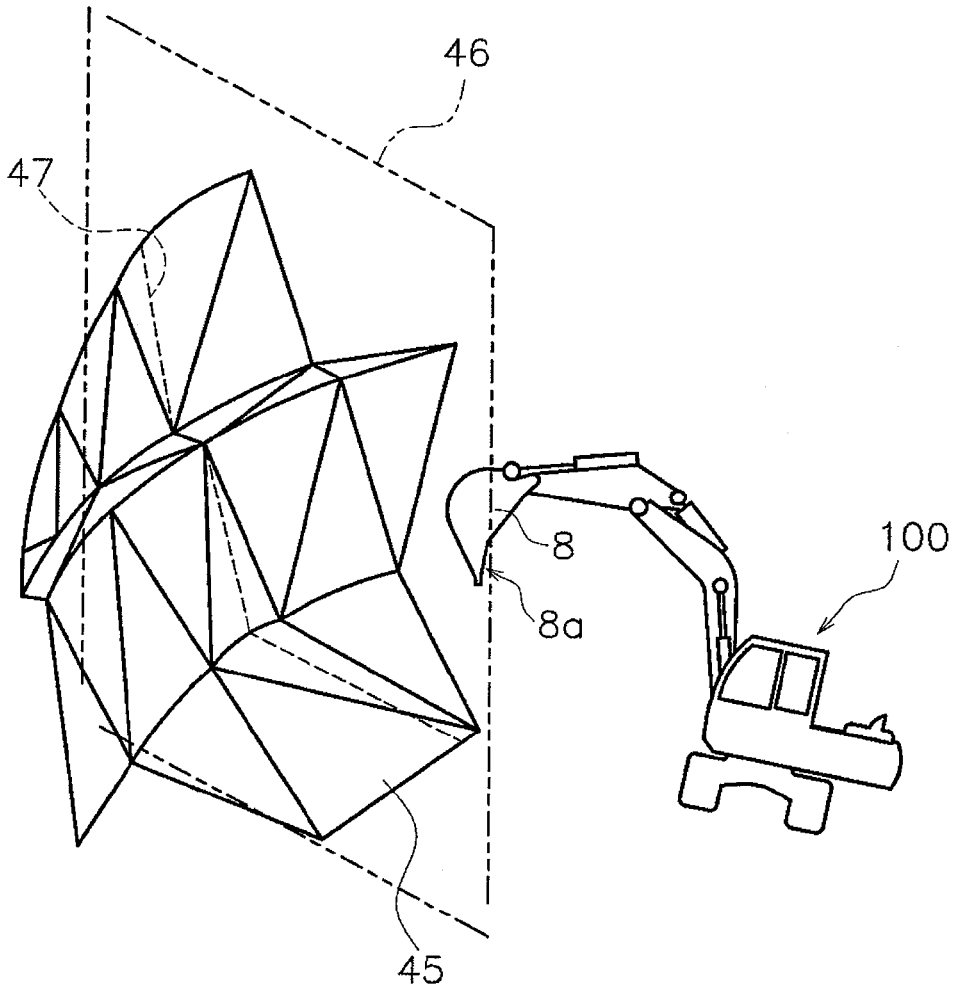
FIG. 4 is a schematic diagram illustrating an exemplary designed landform to be displayed on a display unit 29.

Now, FIG. 4 is a schematic diagram illustrating an exemplary designed landform to be displayed on the display unit 29. As illustrated in FIG. 4, the designed landform is formed by the plurality of designed surfaces 45, each of which is expressed by a triangular polygon. Each of the plurality of designed surfaces 45 indicates the target shape for an object to be excavated by the working unit 2. The working unit controller 26 is configured to move the bucket 8 along an intersected line 47 between the plurality of designed surfaces 45 and a plane 46 passing through the present position of the cutting edge 8*a* of the bucket 8. It should be noted that in FIG. 4, the reference sign 45 is assigned to only one of the plurality of designed surfaces without being assigned to the others of the plurality of designed surfaces.

Figure 5:
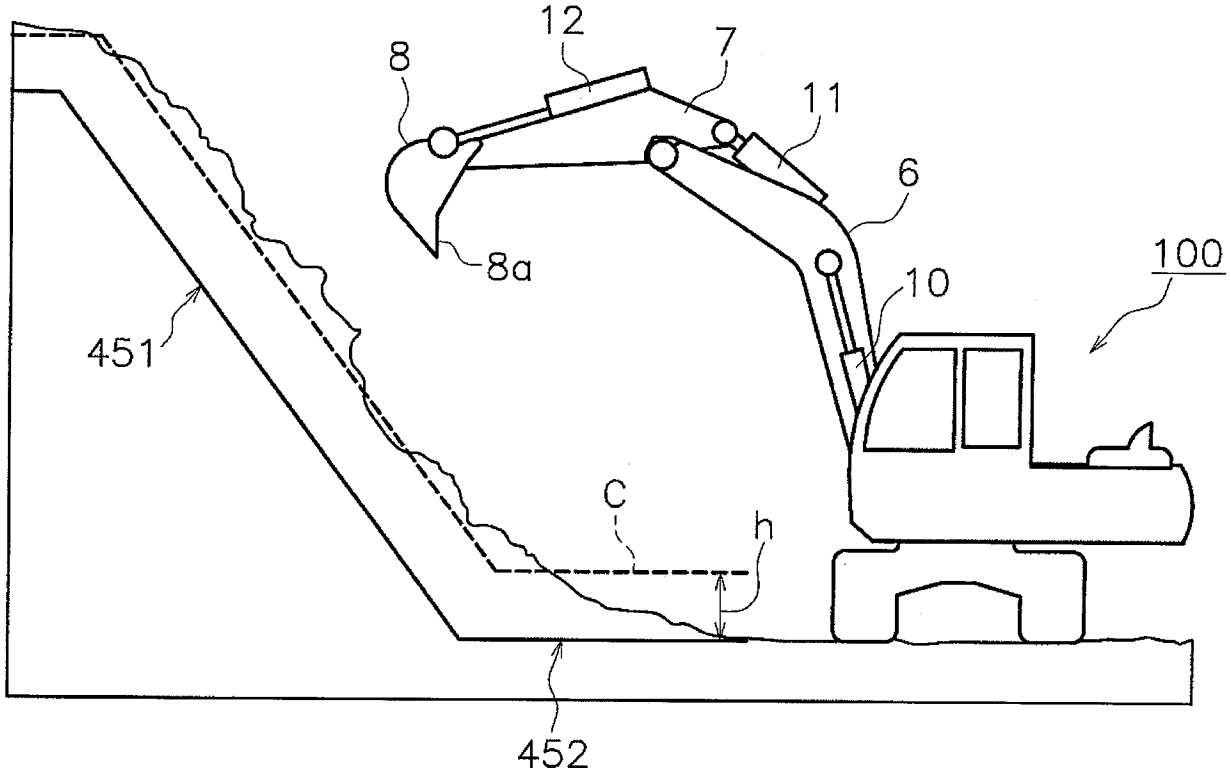
FIG. 5 is a cross-sectional view of the designed landform taken along an intersected line 47.

FIG. 5 is a cross-sectional view of a designed landform taken along the intersected line 47 and is a schematic diagram illustrating an exemplary designed landform to be displayed on the display unit 29. As illustrated in FIG. 5, the designed landform according to the present exemplary embodiment includes a first designed surface 451, a second designed surface 452 and a speed limitation intervening line C.

The first designed surface 451 is a slope positioned laterally to the hydraulic excavator 100. The second designed surface 452 is a horizontal plane extended from the bottom end of the first designed surface 451 to the vicinity of the hydraulic excavator 100. In the present exemplary embodiment, an operator executes excavation along the first designed surface 451 and the second designed surface 452 by moving the bucket 8 from above the first designed surface 451 towards the second designed surface 452.

The speed limitation intervening line C defines a region in which speed limitation to be described is executed. As described below, when the bucket 8 enters inside from the speed limitation intervening line C, the excavation control system 200 is configured to execute speed limitation. The speed limitation intervening line C is set to be in a position away from each of the first designed surface 451 and the second designed surface 452 at a line distance h. The line distance h is preferably set to be a distance whereby operational feeding of an operator with respect to the working unit 2 is not deteriorated.

Configuration of Working Unit Controller 26

Figure 6:
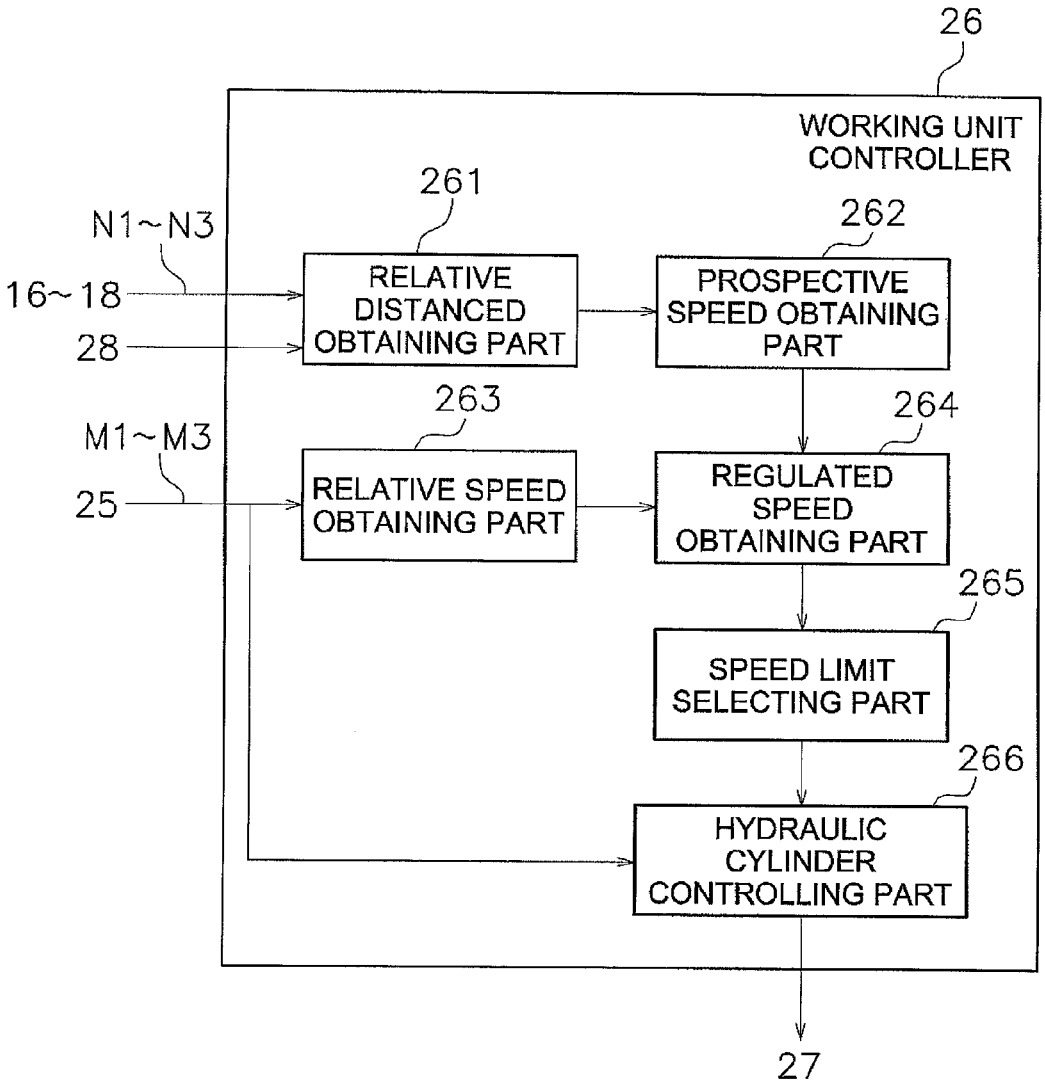
FIG. 6 is a block diagram representing a configuration of a working unit controller 26.
Figure 7:
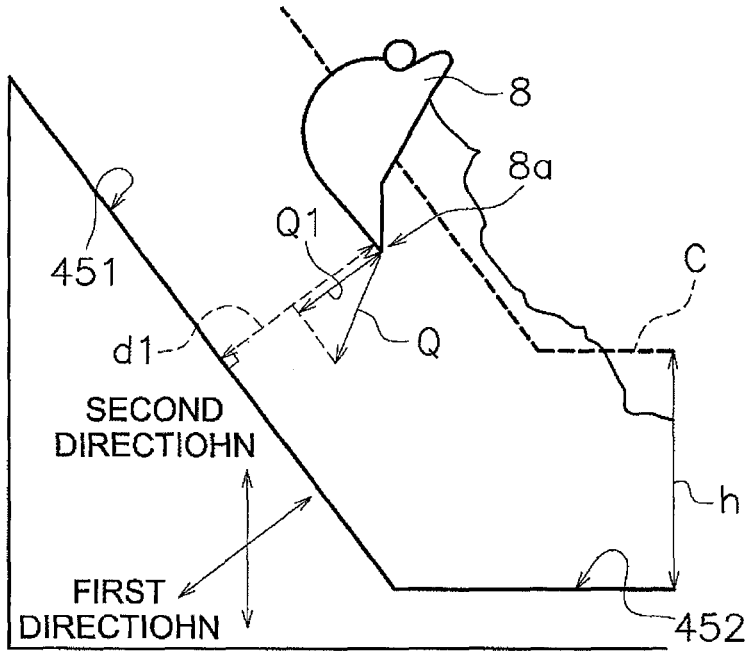
FIG. 7 is a schematic diagram representing a positional relation between a bucket 8 and a first designed surface 451.
Figure 8:
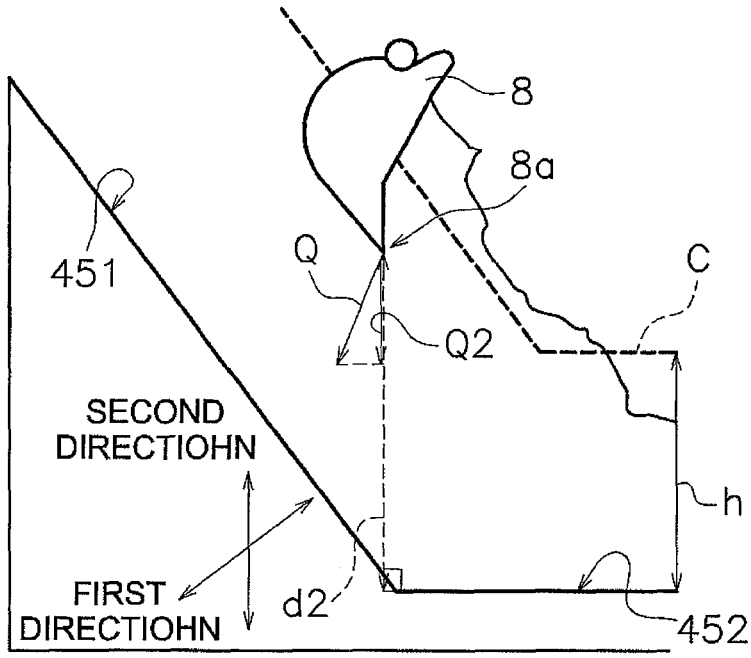
FIG. 8 is a schematic diagram representing a positional relation between the bucket 8 and a second designed surface 452.

FIG. 6 is a block diagram representing a configuration of the working unit controller 26. FIG. 7 is a schematic diagram illustrating a positional relation between the bucket 8 and the first designed surface 451. FIG. 8 is a schematic diagram illustrating a positional relation between the bucket 8 and the second designed surface 452. FIGS. 7 and 8 illustrate a position of the bucket 8 at the same clock time. It should be noted that explanation will be hereinafter made by focusing on the first designed surface 451 and the second designed surface 452 among the plurality of designed surfaces 45.

As represented in FIG. 6, the working unit controller 26 includes a relative distance obtaining part 261, a prospective speed obtaining part 262, a relative speed obtaining part 263, a regulated speed obtaining part 264, a speed limit selecting part 265 and a hydraulic cylinder controlling part 266.

As illustrated in FIG. 7, the relative distance obtaining part 261 is configured to obtain a first distance d1 between the cutting edge 8*a* and the first designed surface 451 in a first direction perpendicular to the first designed surface 451. As illustrated in FIG. 8, the relative distance obtaining part 261 is configured to obtain a second distance d2 between the cutting edge 8*a* and the second designed surface 452 in a second direction perpendicular to the second designed surface 452. The relative distance obtaining part 261 is configured to calculate the first distance d1 and the second distance d2 based on: the set of designed landform data and the set of present positional data of the hydraulic excavator 100, which are obtained from the display controller 28; and the boom cylinder length N1, the arm cylinder length N2 and the bucket cylinder length N3, which are obtained from the first to third stroke sensors 16 to 18. The relative distance obtaining part 261 is configured to output the first distance d1 and the second distance d2 to the prospective speed obtaining part 262. It should be noted that in the present exemplary embodiment, the first distance d1 is less than the second distance d2.

Figure 9:
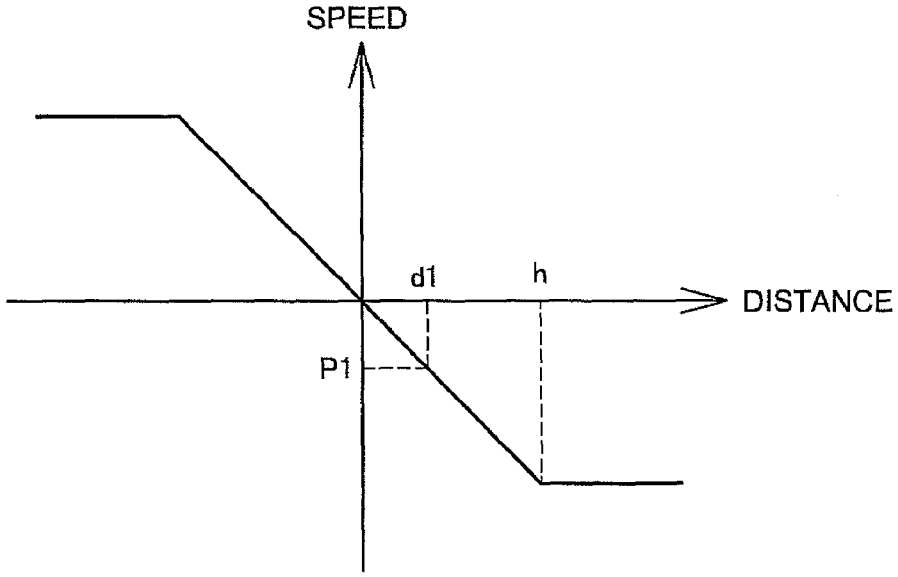
FIG. 9 is a chart representing a relation between a first prospective speed P1 and a first distance d1.
Figure 10:
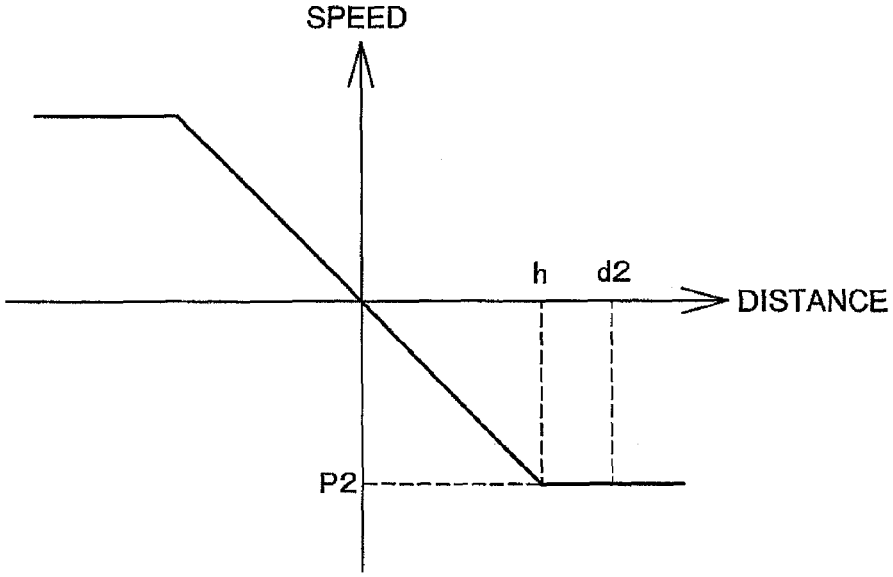
FIG. 10 is a chart representing a relation between a second prospective speed P2 and a second distance d2.

The prospective speed obtaining part 262 is configured to obtain: a first prospective speed P1 set in accordance with the first distance d1; and a second prospective speed P2 set in accordance with the second distance d2. The first prospective speed P1 is herein a speed set in accordance with the first distance d1 in a uniform manner. As represented in FIG. 9, the first prospective speed P1 is maximized where the first distance d1 is greater than or equal to the line distance h, and gets slower as the first distance d1 becomes less than the line distance h. Likewise, the second prospective speed P2 is a speed set in accordance with the second distance d2 in a uniform manner. As represented in FIG. 10, the second prospective speed P2 is maximized where the second distance d2 is greater than or equal to the line distance h, and gets slower as the second distance d2 becomes less than the line distance h. The prospective speed obtaining part 262 is configured to output the first prospective speed P1 and the second prospective speed P2 to the regulated speed obtaining part 264 and the speed limit selecting part 265. It should be noted that a direction closer to the first designed surface 451 is a negative direction in FIG. 9, whereas a direction closer to the second designed surface 452 is a negative direction in FIG. 10. In the present exemplary embodiment, the first prospective speed P1 is slower than the second prospective speed P2.

The relative speed obtaining part 263 is configured to calculate a speed Q of the cutting edge 8*a* based on the boom operation signal M1, the arm operation signal M2 and the bucket operation signal M3, which are obtained from the operating device 25. Further, as illustrated in FIG. 7, the relative speed obtaining part 263 is configured to obtain a first relative speed Q1 of the cutting edge 8*a* with respect to the first designed surface 451 based on the speed Q. As illustrated in FIG. 8, the relative speed obtaining part 263 is configured to obtain a second relative speed Q2 of the cutting edge 8*a* with respect to the second designed surface 452 based on the speed Q. The relative speed obtaining part 263 is configured to output the first relative speed Q1 and the second relative speed Q2 to the regulated speed obtaining part 264.

The regulated speed obtaining part 264 is configured to obtain the first prospective speed P1 from the prospective speed obtaining part 262, while being configured to obtain the first relative speed Q1 from the relative speed obtaining part 263. The regulated speed obtaining part 264 is configured to obtain a first regulated speed S1 for the extension/contraction speed of the boom cylinder 10, which is required to limit the first relative speed Q1 to the first prospective speed P1.

Figure 11:
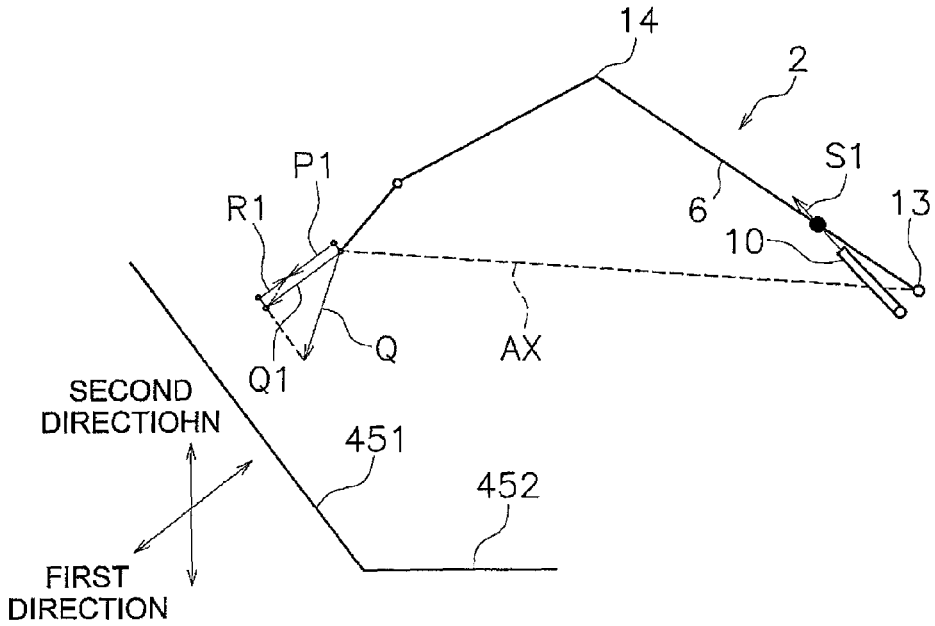
FIG. 11 is a diagram for explaining a method of obtaining a first regulated speed S1.

Now, FIG. 11 is a diagram for explaining a method of obtaining the first regulated speed S1. As illustrated in FIG. 11, the first relative speed Q1 is required to be reduced by the amount of a first differential R1 (=Q1−P1) in order to suppress the first relative speed Q1 to the first prospective speed P1. On the other hand, the speed of the boom 6 is required to be regulated so that the first differential R1 can be eliminated from the first relative speed Q1 only by deceleration in rotational speed of the boom 6 about the boom pin 13. Accordingly, it is possible to obtain the first regulated speed S1 based on the first differential R1.

Further, the regulated speed obtaining part 264 is configured to obtain the second prospective speed P2 from the prospective speed obtaining part 262, while being configured to obtain the second relative speed Q2 from the relative speed obtaining part 263. The regulated speed obtaining part 264 is configured to obtain a second regulated speed S2 for the extension/contraction speed of the boom cylinder 10, which is required to limit the second relative speed Q2 to the second prospective speed P2.

Figure 12:
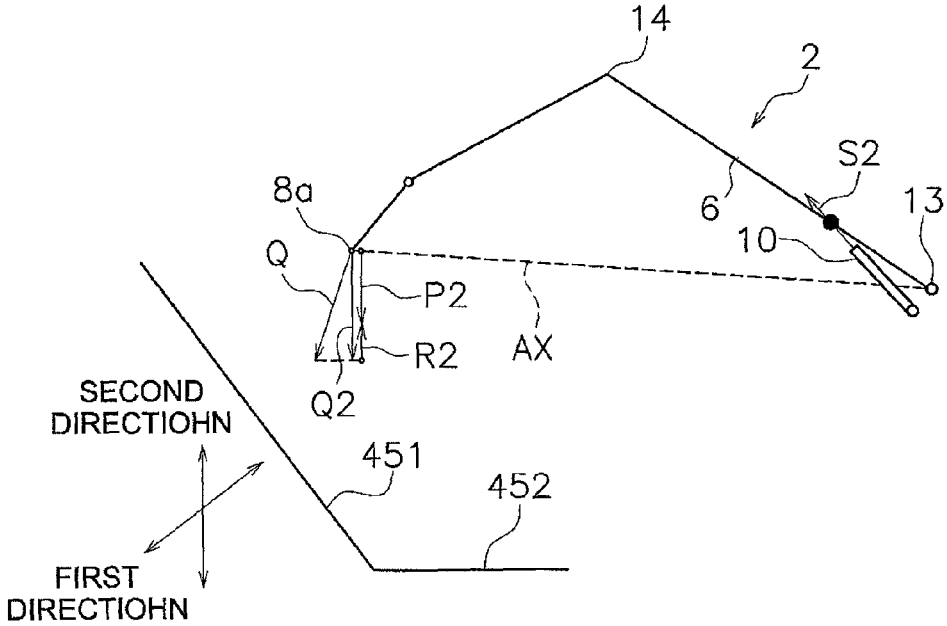
FIG. 12 is a diagram for explaining a method of obtaining a second regulated speed S2.

Now, FIG. 12 is a diagram for explaining a method of obtaining the second regulated speed S2. As illustrated in FIG. 12, the second relative speed Q2 is required to be reduced by the amount of a second differential R2 (=Q2−P2) in order to suppress the second relative speed Q2 to the second prospective speed P2. On the other hand, the speed of the boom 6 is required to be regulated so that the second differential R2 can be eliminated from the second relative speed Q2 only by deceleration in rotational speed of the boom 6 about the boom pin 13. Accordingly, it is possible to obtain the second regulated speed S2 based on the second differential R2.

As illustrated in FIGS. 11 and 12, in the present exemplary embodiment, the first regulated speed S1 is set to be greater than the second regulated speed S2 although the first differential R1 is equivalent to the second differential R2. This is because, when it is attempted to regulate the speed Q of the cutting edge 8*a* by changing the rotational speed of the boom 6 about the boom pin 13, a speed vector is less easily affected by the change of the rotational speed of the boom 6 as the direction of the speed vector gets closer to a reference line AX (a line connecting the boom pin 13 and the cutting edge 8*a*). In other words, in the present exemplary embodiment, it is more difficult to regulate the first relative speed Q1 than to change the second relative speed Q2 by means of changing the rotational speed of the boom 6.

The speed limit selecting part 265 is configured to obtain the first prospective speed P1 and the second prospective speed P2 from the prospective speed obtaining part 262, while being configured to obtain the first regulated speed S1 and the second regulated speed S2 from the regulated speed obtaining part 264. The speed limit selecting part 265 is configured to select either the first prospective speed P1 or the second prospective speed P2 as a speed limit U based on the first regulated speed S1 and the second regulated speed S2. Specifically, the speed limit selecting part 265 is configured to select the first prospective speed P1 as the speed limit U when the first regulated speed S1 is greater than the second regulated speed S2. By contrast, the speed limit selecting part 265 is configured to select the second prospective speed P2 as the speed limit U when the second regulated speed S2 is greater than the first regulated speed S1. In the present exemplary embodiment, the first regulated speed S1 is greater than the second regulated speed S2. Therefore, the speed limit selecting part 265 selects the first prospective speed P1 as the speed limit U.

The hydraulic cylinder controlling part 266 is configured to limit, to the speed limit U, the relative speed Q of the cutting edge 8*a* with respect to the designed surface 45 relevant to the prospective speed P selected as the speed limit U. In the present exemplary embodiment, the hydraulic cylinder controlling part 266 is configured to correct the boom operation signal M1 and is configured to output the corrected boom operation signal M1 to the proportional control valve 27 in order to suppress the first relative speed Q1 to the first prospective speed P1 only by means of deceleration in rotational speed of the boom 6. On the other hand, the working unit controller 26 is configured to output the arm operation signal M2 and the bucket operation signal M3 to the proportional control valve 27 without correcting the signals M2 and M3.

Accordingly, the flow rates of the operating oil to be supplied to the boom cylinder 10, the arm cylinder 11 and the bucket cylinder 12 through the proportional control valve 27 are controlled, and the relative speed Q of the cutting edge 8*a* is controlled. In the present exemplary embodiment, the first prospective speed P1 is selected as the speed limit U. Therefore, the hydraulic cylinder controlling part 266 limits the first relative speed Q1 of the cutting edge 8*a* to the first prospective speed P1.

Action of Excavation Control System 200

Figure 13:
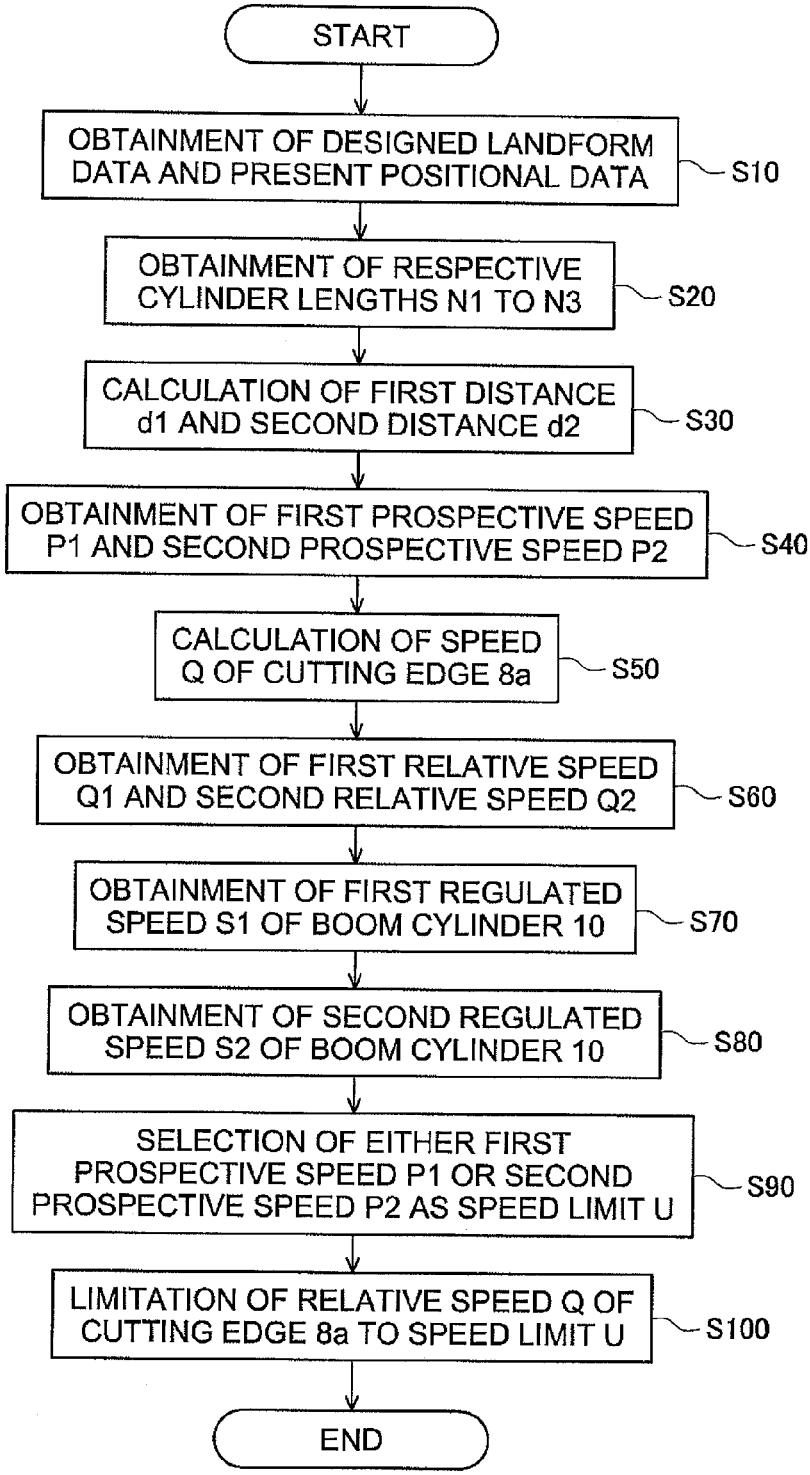
FIG. 13 is a flowchart for explaining an action of the excavation control system 200.

FIG. 13 is a flowchart for explaining an action of the excavation control system 200.

In Step S10, the excavation control system 200 obtains the set of designed landform data and the set of present positional data of the hydraulic excavator 100.

In Step S20, the excavation control system 200 obtains the boom cylinder length N1, the arm cylinder length N2 and the bucket cylinder length N3.

In Step S30, the excavation control system 200 calculates the first distance d1 and the second distance d2 based on the set of designed landform data, the set of present positional data, the boom cylinder length N1, the arm cylinder length N2 and the bucket cylinder length N3 (see FIGS. 7 and 8).

In Step S40, the excavation control system 200 obtains: the first prospective speed P1 depending on the first distance d1; and the second prospective speed P2 depending on the second distance d2 (see FIGS. 9 and 10).

In Step S50, the excavation control system 200 calculates the speed Q of the cutting edge 8*a* based on the boom operation signal M1, the arm operation signal M2 and the bucket operation signal M3 (see FIGS. 7 and 8).

In Step S60, the excavation control system 200 obtains the first relative speed Q1 and the second relative speed Q2 based on the speed Q (see FIGS. 7 and 8).

In Step S70, the excavation control system 200 obtains the first regulated speed S1 for the extension/contraction speed of the boom cylinder 10, which is required for limiting the first relative speed Q1 to the first prospective speed P1 (see FIG. 11).

In Step S80, the excavation control system 200 obtains the second regulated speed S2 for the extension/contraction speed of the boom cylinder 10, which is required for limiting the second relative speed Q2 to the second prospective speed P2 (see FIG. 12).

In Step S90, the excavation control system 200 selects either the first prospective speed P1 or the second prospective speed P2 as the speed limit U based on the first regulated speed S1 and the second regulated speed S2. The excavation control system 200 selects, as the speed limit U, the prospective speed P relevant to the greater one of the first regulated speed S1 and the second regulated speed S2.

In Step S100, the excavation control system 200 limits, to the speed limit U, the relative speed Q of the cutting edge 8*a* with respect to the designed surface 45 relevant to the prospective speed P selected as the speed limit U.

Actions and Effects (1) The excavation control system 200 according to the present exemplary embodiment is configured to obtain: the first regulated speed S1 for the extension/contraction speed of the boom cylinder 10, which is required to limit the first relative speed Q1 to the first prospective speed P1; and the second regulated speed S2 for the extension/contraction speed of the boom cylinder 10, which is required to limit the second relative speed Q2 to the second prospective speed P2. The excavation control system 200 is configured to select, as the speed limit U, the prospective speed P relevant to the grater one of the first regulated speed S1 and the second regulated speed S2.

Thus, in the excavation control where the first designed surface 451 and the second designed surface 452 exist, speed limitation is executed for the cutting edge 8*a* based on the regulated speed S for the extension/contraction speed of the boom cylinder 10. Therefore, speed limitation can be executed based on either one of the first designed surface 451 and the second designed surface 452, which is relevant to the greater regulated speed S for the extension/contraction speed of the boom cylinder 10.

Here, chances are that regulation for the extension/contraction speed of the boom cylinder 10 is delayed if speed limitation is executed based on a given designed surface 45 relevant to the lesser regulated speed S, and thereafter, speed limitation is executed based on another designed surface 45 relevant to the greater regulated speed S. In this case, excavation cannot be executed according to the designed surface when the cutting edge 8*a* goes beyond the designed surface 45. Further, shocks inevitably occur due to abrupt driving when regulation of the boom cylinder 10 is forcibly attempted. Therefore, an appropriate excavation control cannot be executed.

By contrast, according to the excavation control system 200 of the present exemplary embodiment, speed limitation is executed based on the designed surface 45 relevant to the greater regulated speed S as described above. Therefore, the boom cylinder 10 can afford to be regulated. It is thereby possible to inhibit the cutting edge 8*a* from going beyond the designed surface 45 and inhibit occurrence of shocks due to abrupt driving. Accordingly, an appropriate excavation control can be executed.

(2) The excavation control system 200 according to the present exemplary embodiment is configured to execute speed limitation by regulating the extension/contraction speed of the boom cylinder 10.

Therefore, speed limitation is executed by correcting only the boom operation signal M1 among the operation signals in response to operations by an operator. In other words, among the boom 6, the arm 7 and the bucket 8, only the boom 6 is not driven as operated by an operator. Therefore, it is herein possible to inhibit deterioration of operational feeling of an operator in comparison with the configuration of regulating the extension/contraction speeds of two or more driven members among the boom 6, the arm 7 and the bucket 8.

Other Embodiments

An exemplary embodiment of the present invention has been explained above. However, the present invention is not limited to the aforementioned exemplary embodiment, and a variety of changes can be made without departing from the scope of the present invention.

(A) In the aforementioned exemplary embodiment, the excavation control system 200 is configured to select, as the speed limit U, either of the first prospective speed P1 and the second prospective speed P2 based on the first regulated speed S1 and the second regulated speed S2. However, the present invention is not limited to this. The excavation control system 200 may be configured to select either of the speeds P1 and P2 as the speed limit U based on the relative relation between the first designed surface 451 and the bucket 8 and the relative relation between the second designed surface 452 and the bucket 8. For example, the excavation control system 200 can select either of the speeds P1 and P2 as the speed limit U based on the first distance d1 and the second distance d2. In this case, the first prospective speed P1 may be selected as the speed limit U when the second distance d2 is less than the first distance d1, whereas the second prospective speed P2 may be selected as the speed limit U when the first distance d1 is less than the second distance d2.

(B) In the aforementioned exemplary embodiment, the excavation control system 200 is configured to execute an excavation control with respect to two of the plurality of designed surfaces 45, i.e., the first designed surface 451 and the second designed surface 452. However, the present invention is not limited to this. The excavation control system 200 may be configured to execute an excavation control with respect to three or more designed surfaces 45. In this case, the excavation control system 200 may be configured to select the speed limit U through the comparison among the regulated speeds S relevant to all the designed surfaces 45.

(C) In the aforementioned exemplary embodiment, the excavation control system 200 is configured to suppress the relative speed to the speed limit only by deceleration of the rotational speed of the boom 6. However, the present invention is not limited to this. The excavation control system 200 may be configured to regulate the rotational speed of at least one of the arm 7 and the bucket 8 in addition to the rotational speed of the boom 6. It is thereby possible to inhibit the speed of the bucket 8 from being reduced in a direction parallel to the designed surface 45 by means of speed limitation. Accordingly, it is possible to inhibit deterioration of operational feeling of an operator. It should be noted that in this case, addition (sum) of the respective regulated speeds of the boom 6, the arm 7 and the bucket 8 may be calculated as the regulated speed S.

(D) In the aforementioned exemplary embodiment, the excavation control system 200 is configured to calculate the speed Q of the cutting edge 8*a* based on the operation signals M to be obtained from the operating device 25. However, the present invention is not limited to this. The excavation control system 200 can calculate the speed Q based on variation per unit time for each of the cylinder lengths N1 to N3 to be obtained from the first to third stroke sensors 16 to 18. In this case, the speed Q can be more accurately calculated compared to a configuration of calculating the speed Q based on the operation signals M.

(E) In the aforementioned exemplary embodiment, the excavation control system 200 is configured to execute speed limitation in terms of the speed of the cutting edge 8*a* among the portions of the bucket 8. However, the present invention is not limited to this. For example, the excavation control system 200 may be configured to execute speed limitation in terms of the speed of the bottom surface among the portions of the bucket 8.

(F) In the aforementioned exemplary embodiment, as represented in FIGS. 9 and 10, a linear relation is established between the prospective speed and the distance. However, the present invention is not limited to this. An arbitrary relation may be established between the prospective speed and the distance. Such relation is not necessarily a linear relation, and its relational curve is not required to pass through the origin of its relevant chart.

According to the illustrated embodiments, it is possible to provide a working unit control system capable of appropriately executing an excavation control with respect to a plurality of designed surfaces. Therefore, the control system according to the illustrated embodiments is useful for the field of construction machines.

What is claimed is:

1. An excavation control system comprising:

a working unit formed by a plurality of driven members including a bucket, the working unit being rotatably supported by a vehicle main body;

a plurality of hydraulic cylinders configured to drive the plurality of driven members;

a prospective speed obtaining part configured to obtain a first prospective speed and a second prospective speed, the first prospective speed depending on a first distance between the bucket and a first designed surface indicating a target shape for an excavation object, the second prospective speed depending on a second distance between the bucket and a second designed surface indicating the target shape for the excavation object, the second designed surface being different from the first designed surface, the first designed surface and the second designed surface being disposed adjacent to each other;

a speed limit selecting part configured to select either of the first prospective speed or the second prospective speed as a speed limit based on a relative relation between the first designed surface and the bucket and a relative relation between the second designed surface and the bucket; and a hydraulic cylinder controlling part configured to limit a relative speed of the bucket to the speed limit, the relative speed being relative to either one designed surface of the first and second designed surfaces which is a target of the speed limit.

2. The excavation control system recited in claim 1, wherein the first prospective speed gets slower as the first distance gets shorter, and the second prospective speed gets slower as the second distance gets shorter.

3. The excavation control system recited in claim 1, further comprising a relative speed obtaining part configured to obtain a first relative speed of the bucket relative to the first designed surface and a second relative speed of the bucket relative to the second designed surface, wherein the speed limit selecting part is configured to select the speed limit based on a relative relation between the first relative speed and the first prospective speed and a relative relation between the second relative speed and the second prospective speed.

4. The excavation control system recited in claim 3, further comprising a regulated speed obtaining part configured to obtain a first regulated speed and a second regulated speed, the first regulated speed depending on a target speed for an extension/contraction speed of each of the plurality of hydraulic cylinders which is required to limit the first relative speed to the first prospective speed, the second regulated speed depending on a target speed for an extension/contraction speed of each of the plurality of hydraulic cylinders which is required to limit the second relative speed to the second prospective speed, wherein the speed limit selecting part is configured to select the first prospective speed as the speed limit when the first regulated speed is greater than the second regulated speed, and the speed limit selecting part is configured to select the second prospective speed as the speed limit when the second regulated speed is greater than the first regulated speed.

5. The excavation control system recited in claim 4, wherein the plurality of driven members include a boom rotatably attached to the vehicle main body, the plurality of hydraulic cylinders include a boom cylinder for driving the boom, and each of the first regulated speed and the second regulated speed corresponds to a regulated speed for the extension/contraction speed of the boom cylinder.

6. The excavation control system recited in claim 4, wherein the plurality of driven members include a boom rotatably attached to the vehicle main body and an arm coupled to the boom and the bucket, the plurality of hydraulic cylinders include a boom cylinder for driving the boom and an arm cylinder for driving the arm, and each of the first regulated speed and the second regulated speed corresponds to a target speed for extension/contraction speeds of the boom cylinder and the arm cylinder.

7. The excavation control system recited in claim 3, further comprising an operating tool configured to receive an operator operation to drive the working unit, the operating tool being configured to output an operation signal in accordance with the operator operation, wherein the relative speed obtaining part is configured to obtain the first relative speed and the second relative speed based on the operation signal.

8. The excavation control system recited in claim 3, wherein the relative speed obtaining part is configured to obtain the first relative speed and the second relative speed based on sum of extension/contraction speeds of respective ones of the plurality of hydraulic cylinders.

9. The excavation control system recited in claim 1, wherein the speed limit selecting part is configured to select the speed limit based on the first distance and the second distance.

10. The excavation control system recited in claim 9, wherein the speed limit selecting part is configured to select the first prospective speed as the speed limit when the first distance is less than the second distance, and the speed limit selecting part is configured to select the second prospective speed as the speed limit when the second distance is less than the first distance.

11. A construction machine, comprising:

the vehicle main body; and an excavation control system including a working unit formed by a plurality of driven members including a bucket, the working unit being rotatably supported by a vehicle main body, a plurality of hydraulic cylinders configured to drive the plurality of driven members, a prospective speed obtaining part configured to obtain a first prospective speed and a second prospective speed, the first prospective speed depending on a first distance between the bucket and a first designed surface indicating a target shape for an excavation object, the second prospective speed depending on a second distance between the bucket and a second designed surface indicating the target shape for the excavation object, the second designed surface being different from the first designed surface, the first designed surface and the second designed surface being disposed adjacent to each other, a speed limit selecting part configured to select either of the first prospective speed or the second prospective speed as a speed limit based on a relative relation between the first designed surface and the bucket and a relative relation between the second designed surface and the bucket, and a hydraulic cylinder controlling part configured to limit a relative speed of the bucket to the speed limit, the relative speed being relative to either one designed surface of the first and second designed surfaces which is a target of the speed limit.

12. The excavation control system recited in claim 1, wherein the hydraulic cylinder controlling part limits the relative speed of the bucket to the speed limit when at least a portion of the bucket is within a region defined by the first designed surface, the second designed surface, and a speed limitation intervening line, the speed limitation intervening line being positioned away from each of the first designed surface and the second designed surface at a prescribed line distance.

13. The excavator control system recited in claim 1, wherein the first distance is obtained in a direction perpendicular to the first designed surface and the second direction being obtained in a direction perpendicular to the second designed surface.

14. The excavator control system recited in claim 1, wherein the first distance and the second distance are both distances of the bucket above the first and second designed surfaces, respectively.

15. The excavator control system recited in claim 13, wherein the first distance and the second distance are both distances of the bucket above the first and second designed surfaces, respectively.

16. The excavator control system recited in claim 1, wherein the first designed surface and the second designed surface are non-parallel to each other.

17. The excavator control system recited in claim 1, wherein the second designed surface extends from an end of the first designed surface.

18. The excavator control system recited in claim 17, wherein the first designed surface and the second designed surface are non-parallel to each other.

* * * * *